US005462462A

United States Patent [19]

Woodley

[11] Patent Number: 5,462,462

[45] Date of Patent: Oct. 31, 1995

[54] MODIFIED PROPELLER BLADE

[76] Inventor: Frank Woodley, 3106 Karen Dr., Naples, Fla. 33962

[21] Appl. No.: 400,455

[22] Filed: Mar. 7, 1995

Related U.S. Application Data

[63] Continuation of Ser. No. 893,834, Jun. 4, 1992, abandoned.

[51] Int. Cl.[6] ..... B63H 1/14

[52] U.S. Cl. ..... 440/49; 416/224; 440/73

[58] Field of Search ..... 440/49, 71; 416/223, 416/224, 241 A

[56] References Cited

U.S. PATENT DOCUMENTS

| | | | |
|---|---|---|---|
| 1,514,246 | 11/1924 | Assala | 416/224 |
| 1,860,557 | 5/1932 | Sukohl | 416/224 |
| 4,875,829 | 10/1989 | Van der Woude | 416/241 A |
| 5,174,024 | 12/1992 | Sterrett | 416/224 |

FOREIGN PATENT DOCUMENTS

| | | | |
|---|---|---|---|
| 195916 | 7/1967 | U.S.S.R. | 416/224 |

*Primary Examiner*—Jesus D. Sotelo
*Attorney, Agent, or Firm*—William F. Hamrock

[57] ABSTRACT

A plastic propeller for marine electric trolling motors modified to prevent the entanglement and build-up of weeds by the application to its surface of a thin sheet of metal formed in the shape and size of the blade and extending beyond the blade's leading edge.

7 Claims, 1 Drawing Sheet

MODIFIED PROPELLER BLADE

This application is a continuation of application Ser. No. 07/893,834, filed Jun. 4, 1992, now abandoned.

BACKGROUND OF THE INVENTION

1. Field of the Invention

This invention relates to plastic propeller blades for electric marine trolling motors, and more particularly, to the modification of the plastic propeller blades to prevent weed entanglement thereof while in use.

2. Description of the Prior Art

There has been a problem with weeds entangling about the propeller and plastic blades of marine electric trolling motors. It is particularly a problem with certain types of weeds, such as peppergrass and eel grass, which tend to wrap around the hub and blades of the motor causing malfunctioning or complete stalling of the motor due to insufficient power to overcome the force of weeds entanglement. In order to restart the motor, the weeds must be removed. Sometimes this is done by reversing the rotation of the propeller and blades. In other instances, it requires pulling the motor out of the water and restarting it so as to fling off the weeds. In the most difficult circumstances, the weeds must be manually pulled off or cut off usually after removing the motor from the water.

Most of the marine electric trolling motors being manufactured and in the market place at the present time include propellers having a plastic hub with plastic blades. The manufacturers appear to use different types of plastic, such as ABS or Lexan. Most of the manufacturers advertise that their plastic propellers with plastic blades are weedless, that is, that they will operate in a weedy environment without the propeller becoming entangled by the individual weeds. Usually these weedless propellers include a central hub with 2 to 4 blades extending radially therefrom. It is stated by some manufacturers that the specific designs of their plastic propellers result in their propellers being weedless due to modifying the flow of the water so as to prevent entanglement of the weeds.

Based upon my observations these plastic propellers are not weedless when operating in waters containing peppergrass and eel grass. My views are based upon several years of experience of having used numerous models of marine electric trolling motors with plastic propellers and plastic blades from many manufactures while fishing either from my boat or from many other boats. To the best of my knowledge there is no marine electric trolling motor with plastic propeller and plastic blades in existence which will operate weedlessly when exposed to tough weeds similar to peppergrass and eel grass irregardless to their designs of the propellers and blades.

It is known in the prior art to protect the leading edges of turbine blades from erosion by modifying the blades with a more erosion resistant material.For example, U.S. Pat. No. 3,275,295 protects the leading edge of a steel turbine blade by forming a flat face on the blade with a cobalt chrome alloy bonded to a flat face formed on the blade. U.S. Pat. No. 4,808,055 restores the top of an eroded metal turbine engine blade with a metallurgically bonded wear resistant surface.

Although there is prior art directed to modifying turbine blades to prevent erosion, I am not aware of prior art directed to modifying plastic blades of propellers of marine electric trolling motors to prevent entanglement of weeds without reducing the efficiency of the operation of the propeller.

SUMMARY OF THE INVENTION

It is an object of the present invention to modify the structure of plastic propellers of marine electric trolling motors to prevent the entanglement and build-up of weeds, especially heavy weeds on the propellers.

It is another object of the present invention to modify the plastic blade structure in a simple and inexpensive manner.

It is a further object of the present invention to modify the plastic blade structure without decreasing the efficiency of the operation of the propeller.

It is my opinion that the plastic blades of the propellers presently being manufactured for marine electric trolling motors simply are not tough enough to cut or break the grass stems encountered in the every day operation in various water ways. To overcome this problem, my invention provides a plastic blade which has been modified by applying to its surface a thin sheet of metal, such as stainless steel, which is formed to the shape and size of the blade and extending beyond the blade's leading edge. Initially, the sheet of metal is adhered to the blade surface with adhesive. The blade is then drilled and tapped after which machine screws are inserted which are then ground flush with the metal surface providing smooth surfaces. The junction between the leading edge of the plastic blade and the overlapping metal sheet covering is then filled and cushioned with adhesive to provide a smooth, even joint. The result of this modification on propellers having 2-,3- and 4-blades not only has prevented the entanglement of any of the heavy water grasses but also has increased the efficiency of the propeller operation.

BRIEF DESCRIPTION OF THE DRAWINGS

Although such novel feature believed to be characteristic of the invention are pointed out in the claims, the invention and the manner in which it may be carried out may be further understood by reference to the following disclosure and to the accompanying drawings.

DESCRIPTION OF THE PREFERRED EMBODIMENT

The propeller blade disclosed herein is not merely a weedless blade but is designed substantially to improve the efficiency and operation of marine electric trolling motors utilizing propellers with plastic blades.

The present invention incorporates a thin sheet of metal which becomes an integral component of the propeller blade in that it is secured to the leading edge of the blade. This modified blade possesses numerous advantages and features which distinguishes it from prior art propeller blades.

The presence of the sheet of metal which is adhesively and/or mechanically secured, cushioned and smoothed to the plastic blade surface provides improved structural strength by reinforcing the body of the plastic blade. Thus, the blade is protected from rupturing caused by the stresses created by its acceleration through the water and/or by its encounter with debris.

A further advantage of the present invention when using stainless steel as the metal sheeting is that some of the improvements attributed to using propeller blades made completely of stainless steel are incorporated into the presently modified propeller blade. It appears that the stainless steel sheeting improves the efficiency of propeller operation while preventing entanglement of weeds on the propeller structure.

Figure 1:
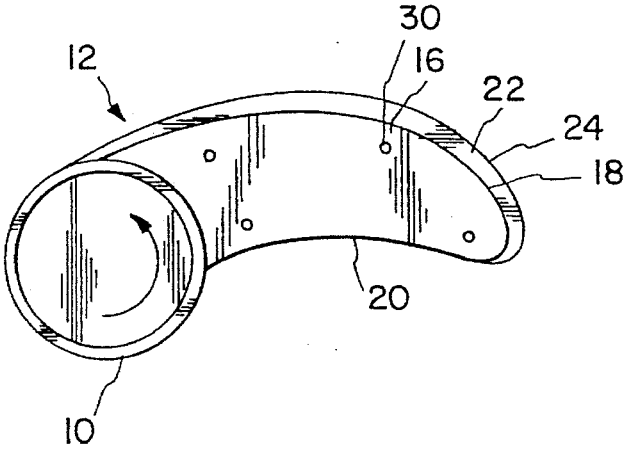
FIG. 1 illustrates a structural bottom view of a blade attached to a hub means.

Usually commercial marine electric trolling motors include a central hub means with two, three or four plastic propeller blades extending radially therefrom. Referring to the drawings, and in particular to FIG. 1, in order to demonstrate the present invention, there is sketched an example of a hub means 10 the arrow reflecting in the forward direction. Shown extending radially from hub means 10 is a preferred embodiment of a modified propeller blade 12. The modified blade 12 as shown includes a plastic propeller blade 14 seen in FIG. 2 having a top surface 16 with a leading edge 18 and trailing edge 20. The top surface 16 is substantially covered by a thin metal sheet 22 which is formed to the shape and size of the top blade surface 16 so as to snugly cover it and to overlap its leading edge with a thin metal edge 24 as shown so as to absorb cutting the weeds and preventing entanglement. Preferably, the thin metal sheet 22 is stainless steel. It has been found that a stainless steel sheet about 0.040 inch in thickness when secured to the plastic blade 14 is the most efficient in preventing the entanglement of any weeds and especially peppergrass and eel grass. As a result, the efficiency of the motor is increased not only because the entanglement of the weeds about the propeller is prevented but also because of unique stainless steel—plastic blade sandwich structure in accordance with its invention.

The sheet of stainless steel metal 22 is secured to the top blade surface 16 with adhesive 28. The stainless steel metal 22 covered plastic blade 14 is then drilled and tapped with machine screws 30. The area of the machine screws is then ground flush with the stainless steel metal surface to provide an smooth, even modified blade surface. The junction 32 between the leading edge 18 of the plastic blade 14 and the overlapping stainless steel metal sheet edge 24 is filled and cushioned with adhesive 28 gradually extending beyond the plastic blade to provide a smooth, even junction.

Figure 2:
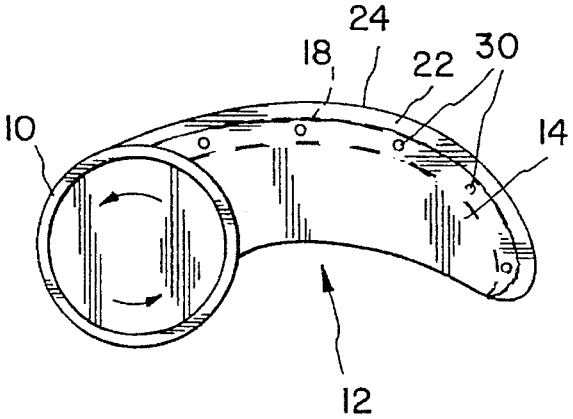
FIG. 2 illustrates a bottom view of another embodiment of a blade according to the invention.

FIG. 2 illustrates another embodiment of the invention. As seen in FIG. 2, the thin stainless steel metal sheet 22 is formed to the shape and size of only the area of the leading edge 18 of plastic propeller blade top surface 16. In this embodiment, the thin stainless steel sheet 22 is secured to the leading edge blade area and overlaps it as shown so as to absorb the energy of impact of any weeds and thereby cutting the weeds to prevent entanglement.

A further embodiment not shown, is directed to inserting and sandwiching a thin strip of metal within the leading edge of the plastic propeller blade at time of manufacture of the blades. In this embodiment, the steel strip extends about ¼ to ⅜ inch beyond the leading edge of the plastic blade.

Figure 3:
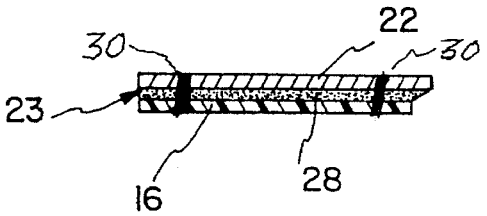
FIG. 3 illustrating a view of a cross-section of a blade.

FIG. 3 illustrates a cross section view through line 3— 3 of FIG. 1. In FIG. 3, it is clearly seen that bottom surface 23 of the thin stainless steel sheet 22 substantially conforms to the shape and size of the top blade surface 16.Sandwiched between the top blade surface 16 and the bottom surface 23 of sheet 22 is an adhesive 28. Machine screws 30 are shown further securing the thin stainless steel sheet 22 to the plastic blade top surface 16 producing the unified blade structure of the invention.

Figure 4:
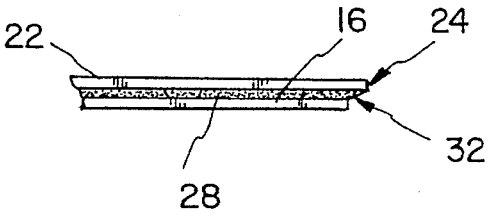
FIG. 4 illustrates a sectional view of the junction of overlapping metal and plastic blade edge.

Shown in FIG. 4 is an illustration of the junction between the propeller plastic blade leading edge 18 and the overlapped thin stainless steel metal edge 24. The adhesive 28 is shown gradually extending beyond the plastic blade leading edge 18 in forming a smooth surface junction 32 with the stainless steel strip.

It will be understood by those skilled in the art that the modified propeller blade of this invention is a durable propeller blade which applied to a marine electric trolling motor will improve its weedless operation.

It will further be understood by those skilled in the art that various modifications may be made without departing from the spirit and scope of the invention.

What is claimed is:

1. In a marine electric trolling motor having a hub means with a propeller means having at least one plastic blade extending radially from the propeller and hub means, said plastic blade having a body portion providing top and bottom surfaces with a leading edge and a trailing edge, the improvement comprising:

said plastic blade surface is modified at least in part by a thin metal sheet mounted thereon, said thin metal sheet having a thin metal forward cutting edge extending outwardly beyond the leading edge of the plastic blade, said thin metal forward cutting edge cuts weeds during marine operation preventing entanglement of weeds on said blade and propeller means.

2. The modified plastic blade of claim 1 wherein said thin metal sheet is mounted by means of a layer of adhesive.

3. The modified plastic blade of claim 2 wherein said thin metal sheet is mounted further with machine screws ground flush with the metal and plastic surfaces.

4. The modified plastic blade of claim 3 wherein said thin metal sheet is a stainless steel metal sheet.

5. The modified plastic blade of claim 4 wherein said metal sheet covers the entire top surface of the plastic blade.

6. The modified plastic blade of claim 4 wherein the metal sheet covers only part of the top surface of the plastic blade.

7. The modified plastic blade of claim 4 wherein the thickness of the stainless steel metal sheet is about 0.04 inch.

* * * * *